US008840362B2

(12) United States Patent
Ito et al.

(10) Patent No.: US 8,840,362 B2
(45) Date of Patent: Sep. 23, 2014

(54) STEAM TURBINE

(75) Inventors: Shoko Ito, Kanagawa (JP); Iwataro Sato, Kanagawa (JP); Kazutaka Ikeda, Tokyo (JP); Asako Inomata, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 354 days.

(21) Appl. No.: 12/955,605

(22) Filed: Nov. 29, 2010

(65) Prior Publication Data

US 2011/0171005 A1 Jul. 14, 2011

(30) Foreign Application Priority Data

Jan. 12, 2010 (JP) ..... 2010-004057

(51) Int. Cl.

| | |
|---|---|
| ***F01D 5/08*** | (2006.01) |
| ***F01D 5/18*** | (2006.01) |
| ***F01D 11/04*** | (2006.01) |
| ***F01D 11/00*** | (2006.01) |
| ***F01D 9/06*** | (2006.01) |

(52) U.S. Cl.

CPC ..... *F01D 5/081* (2013.01); *F01D 11/04* (2013.01); *F01D 11/001* (2013.01); *F05D 2220/31* (2013.01); *F01D 9/065* (2013.01)

USPC ..... 415/115

(58) Field of Classification Search

USPC ..... 415/108, 114, 115, 116; 416/96 R

See application file for complete search history.

(56) References Cited

U.S. PATENT DOCUMENTS

| | | | | |
|---|---|---|---|---|
| 2,896,906 | A * | 7/1959 | Durkin | 415/115 |
| 3,429,557 | A * | 2/1969 | Brandon et al. | 415/58.7 |
| 4,589,256 | A | 5/1986 | Akiba et al. | |
| 5,205,706 | A * | 4/1993 | Belcher | 415/105 |
| 5,253,976 | A * | 10/1993 | Cunha | 415/114 |
| 2002/0150467 | A1 * | 10/2002 | Tanioka | 415/115 |
| 2004/0136828 | A1 * | 7/2004 | Montgomery | 415/208.2 |
| 2007/0071597 | A1 * | 3/2007 | Montgomery | 415/174.5 |
| 2009/0208323 | A1 | 8/2009 | Bowen et al. | |

FOREIGN PATENT DOCUMENTS

| | | |
|---|---|---|
| JP | 59-041603 A | 3/1984 |
| JP | 63-230904 A | 9/1988 |

* cited by examiner

*Primary Examiner* — Ned Landrum
*Assistant Examiner* — Brian O Peters
(74) *Attorney, Agent, or Firm* — Foley & Lardner LLP

(57) ABSTRACT

According to an embodiment, at least one first outer ring has an annular outer ring cavity to which external cooling steam is supplied. A radial direction cooling hole connecting with the outer ring cavity is formed in the stator blades connected to the first outer ring. An annular inner ring cavity connecting with the radial direction cooling hole is formed in a first inner ring constituting one diaphragm together with the first outer ring. Cooling steam blowing holes connecting an annular wheel space and the inner ring cavity are formed. The annular wheel space is formed between the first inner ring and a rotor wheel adjacent to the first inner ring.

4 Claims, 5 Drawing Sheets

STEAM TURBINE

CROSS REFERENCES TO RELATED APPLICATIONS

This application is based upon and claims the benefits of priority from the prior Japanese Patent Application No. 2010-004057, filed in the Japanese Patent Office on Jan. 12, 2010, the entire content of which is incorporated herein by reference.

FIELD

The embodiments of the present invention relates to a steam turbine provided with a rotor cooling method by supplying cooling steam from outside.

BACKGROUND

Ferritic heat-resistant steel excellent in productivity and economic efficiency has been used in the major part of the high temperature part of a thermal power generation plant. For example, in a steam turbine power generation plant in which steam temperature of 600 degree-C. class or less is generally set as the steam condition, the ferritic heat-resistant steel is used in main components such as a rotor or blades of the steam turbine. However, in recent years, the efficiency of the thermal power generation plant has been actively promoted in view of environmental protection, and a steam turbine using high temperature steam of about 600 degree-C. is operated. Such a steam turbine may include many components in which required characteristics are not satisfied by the characteristics of the ferritic heat-resistant steel.

Therefore, there is a case where heat-resistant alloy or austenitic heat-resistant steel having higher temperature characteristics is used. However, the austenitic steel has a limitation in producing a large steel ingot, making it difficult for the austenitic steel to be applied to the components of the steam turbine. Therefore, a configuration is proposed in which the use of the austenitic steel is reduced in the steam turbine using a high temperature steam of 650 degree-C. or more.

There is a growing need for an increase in the thermal efficiency for reducing generation of $CO_2$, SOx, and NOx from the viewpoint of protection of the global environment. In order to increase the plant thermal efficiency of the thermal power generation plant, an increase in the steam temperature is the most effective means, and development of a steam turbine of 700 degree-C. class is now under consideration. There are several problems to be solved in the case where the steam temperature is increased to 700 degree-C. or more. Among them, how the strengths of turbine components are guaranteed is particularly an important issue.

Conventionally, a modified heat-resistant steel is used in the turbine components such as rotors, nozzles, rotor blades, nozzle boxes (steam chambers), and steam supply pipes. However, an increase in the steam temperature to 700 degree-C. or more makes it difficult to retain a high strength of the turbine components. Thus, achievement of a new technique capable of retaining a high strength even if the conventional modified heat-resistant steel is used in the turbine components is required. In particular, the rotor assumes a high stress field by centrifugal force during operation and thus needs to be cooled so as to retain sufficient high temperature strength.

In response to the above needs, a method of cooling the rotor by distributing cooling steam inside the rotor is proposed. However, it is difficult to smoothly distributing the cooling steam inside the rotor which is a rotation field and to secure a sufficient flow rate of the cooling steam to prevent high temperature main steam from flowing into the rotor cooling area. Further, when a large amount of cooling steam is made to flow into a main steam path for cooling, the turbine efficiency may be reduced, which may in turn cause a reduction in the thermal efficiency of the entire plant.

In Japanese Patent Application Laid-Open Publication No. 63-230904 (Patent Document 1), the entire content of which is incorporated herein by reference, an apparatus that cools a rotor by blowing cooling steam to a wheel space is proposed.

However, in the example of FIG. 1 of Patent Document 1, it is not clear whether a steam pipe penetrating a casing penetrates a diaphragm or forms a cooling path different from the diaphragm. The steam pipe is directly connected to a blowing hole and it is difficult to supply cooling steam to the blowing hole at uniform pressure. In the example of FIG. 3 of Patent Document 1, a steam pipe is not provided for each stator blade, and a circumferential direction cooling steam path is provided for aiming at uniform inflow of cooling steam from the blowing hole in the dovetail portion of the rotor blade. However, sufficient uniformity of a cooling steam pressure against each blowing hole cannot be ensured.

The present invention has been made in view of the above problems, and an object thereof is to provide a steam turbine that supplies cooling steam at more uniform pressure to a blowing hole of the inner ring of a diaphragm to further increase thermal efficiency without reducing the efficiency of a steam turbine driven by high temperature steam.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION

According to an aspect of the present invention, a steam turbine comprises: a plurality of annular diaphragms arranged spaced apart from one another in axial direction; a rotor rotatable about its axis, in which a plurality of rotor wheels extending both in the radial direction outward and in circumferential direction are formed spaced apart from one another in the axial direction at locations sandwiched by the plurality of diaphragms in the axial direction; and a plurality of rotor blades fixed to outsides of the plurality of respective rotor wheels so as to be arranged spaced apart from one another in the circumferential direction. Each of the diaphragms includes: an annular outer ring; an annular inner ring arranged radially inside of the outer ring; and a plurality of stator blades arranged between the outer ring and inner ring, the stator blades being connected to the outer ring and being spaced apart from one another in the circumferential direction. The plurality of outer rings include at least one first outer ring in which an annular outer ring cavity to which external cooling steam is supplied is formed. A radial direction cooling hole extending in the radial direction while connecting with the outer ring cavity is formed in at least one of the plurality of stator blades connected to the first outer ring. An annular inner ring cavity connecting with the radial direction cooling hole is formed in a first inner ring constituting one diaphragm together with the first outer ring. A plurality of cooling steam blowing holes connecting an annular wheel space and the inner ring cavity are formed, the annular wheel space being formed between the first inner ring and one of the rotor wheels that is adjacent to the first inner ring.

Embodiments of the present invention will be described with reference to the accompanying drawings. In the second and subsequent embodiments hereinafter described, descriptions of the identical components and components having similar functions to those of the first embodiment are omitted.

First Embodiment

Figure 1:
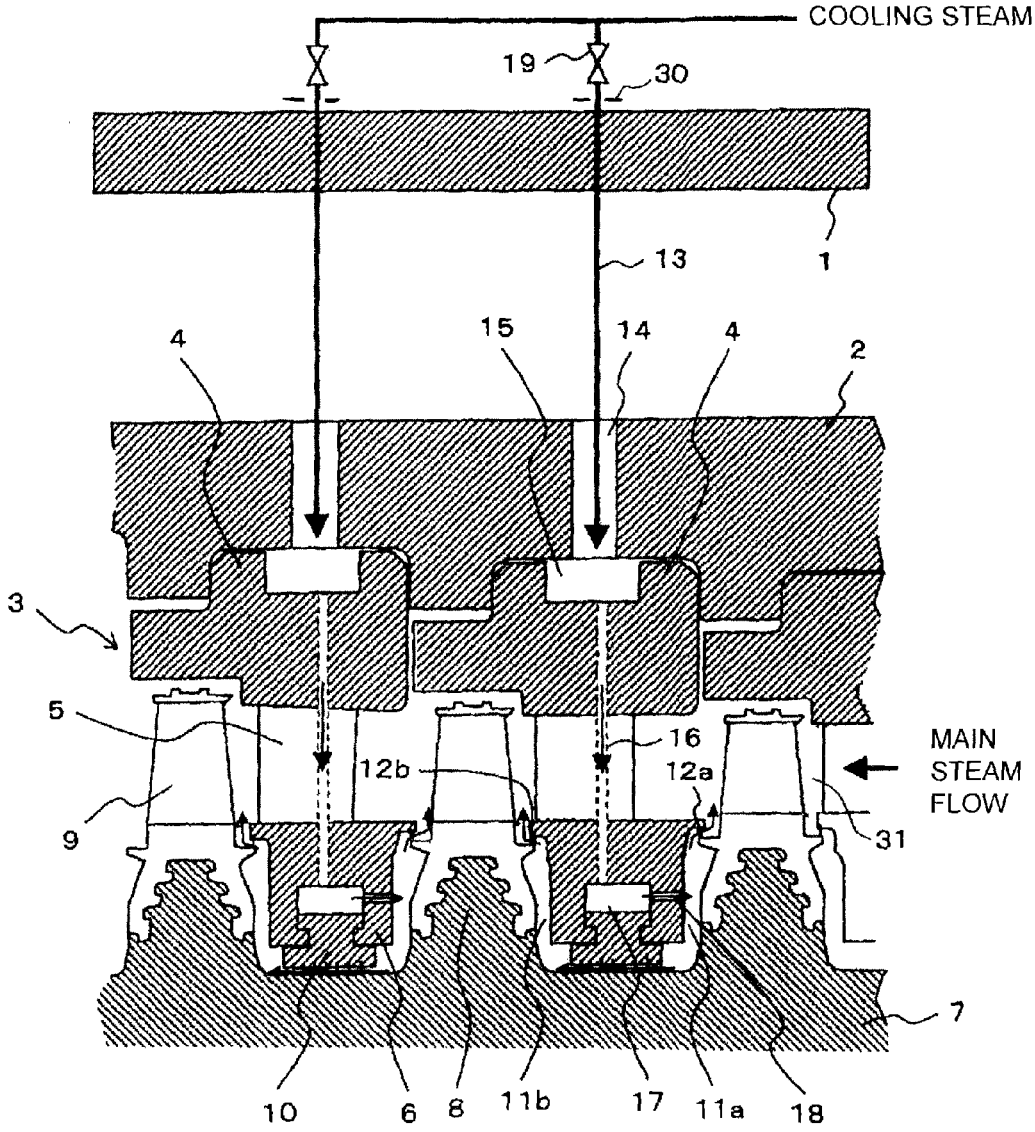
FIG. 1 is an axial direction cross-sectional view illustrating a steam turbine according to a first embodiment of the present invention.

FIG. 1 is an axial direction cross-sectional view illustrating a steam turbine according to a first embodiment of the present invention.

It is assumed that the right side on the paper surface of FIG. 1 is the upstream side and the left side thereof is the downstream side. The stationary side of the steam turbine includes an outer casing 1, an inner casing 2, and diaphragms 3 of individual stages. The diaphragm 3 includes an outer-ring 4, a plurality of stator blades 5, and an inner ring 6. The rotation side of the steam turbine includes a wheel type rotor 7 in which a rotor wheel 8 is formed for each stage and a plurality of rotor blades 9 implanted to the rotor wheel 8. Wheel spaces 11*a* and 11*b* are formed in a space between the inner ring 6 and rotor wheels 8 on the upstream and downstream sides of the inner ring 6. Main steam flowing through a main steam path 31 is prevented from flowing into the wheel spaces 11*a* and 11*b* by wheel space seal portions 12*a* and 12*b* such as a seal fin. A packing ring 10 in which a labyrinth packing is implanted is attached to the inner ring side portion facing the rotor 7 so as to seal leakage of the steam from the stator blade upstream side wheel space 11*a* to the downstream side wheel space 11*b*.

As a structure adopted in the present invention, outer ring cavity 15 for supplying cooling steam is annularly formed between the inner casing 2 and inner-side outer ring 4. To this portion, a cooling steam supply line 13 externally extending through the outer casing 1 is connected.

The cooling steam supply line 13 penetrates the outer casing 1 and the inner casing 2, and the leading end of the cooling steam supply line 13 disposed in a cooling steam inlet port 14 of the inner casing 2. With this configuration, the cooling steam supply line 13 connected to the outer ring cavity 15 can be provided irrespective of the number of stator blades 5. That is, the number of the cooling steam supply lines 13 can be reduced to the number required in the circumferential direction, simplifying the structure. An annular inner ring cavity 17 is formed in the inner ring 6 at the portion in which the packing ring 10 is fit, and the outer ring cavity 15 and inner ring cavity 17 communicate with each other via a radial direction cooling hole 16 formed for each of the plurality of stator blades 5. Further, a plurality of blowing holes 18 extending from the inner ring cavity 17 are formed and aligned with intervals in the circumferential direction. The blowing holes 18 for blowing cooling stream communicate with the stator blade upstream side wheel space 11*a*. With the formation of the inner ring cavity 17, the blowing hole 18 can be provided irrespective of the number of the stator blades 5. That is, the number of the blowing holes can be reduced according to the need. The radial direction cooling hole 16 may be provided not for all the stator blades 5 in one stage but for a part of the stator blades 5.

The above structure is provided for each turbine stage to be cooled, and cooling steam is externally supplied to each stage. Further, a flow rate control valve 19 is provided for each cooling steam supply line 13.

Operation of the present embodiment will next be described.

Cooling steam supplied to the outer ring cavity 15 assumes uniform pressure in the circumferential direction in the outer ring cavity 15. The cooling steam then cools each stator blades 5 while passing through the radial direction cooling hole 16 in each stator blades and flows into the inner ring cavity 17. Uniform pressure is also maintained in the circumferential direction within the inner ring cavity 17, so that the flow rate of the cooling steam flowing into the radial direction cooling hole 16 in the stator blades 5 is the same between the stator blades 5. After that, the cooling steam is blown from the inner ring cavity 17 with uniform pressure to the stator blade upstream side wheel space 11*a* through the blowing holes 18 aligned in the circumferential direction at the same flow rate.

Part of the cooling steam blown to the stator blade upstream side wheel space 11*a* passes through the wheel space seal portion 12*a* while cooling the surface of the rotor wheel 8 of the upstream side stage and enters the main steam path 31. The remaining part of the cooling steam passes the labyrinth seal portion of the inner ring 6 while cooling the surface of the rotor 7 and flows into the stator blade downstream side wheel space 11*b*. Thereafter, the cooling steam passes through the wheel space seal portion 12*b* while cooling the surface of the rotor wheel 8 and enters the main steam path 31.

The flow rates of the cooling steam blown from the wheel spaces 11*a* and 11*b* to the main steam path 31 each need to be not less than the minimum flow rate to prevent the main steam from flowing into the wheel spaces 11*a* and 11*b* at the time of rotation of the rotor 7. This minimum flow rate differs for each wheel space.

Figure 2:
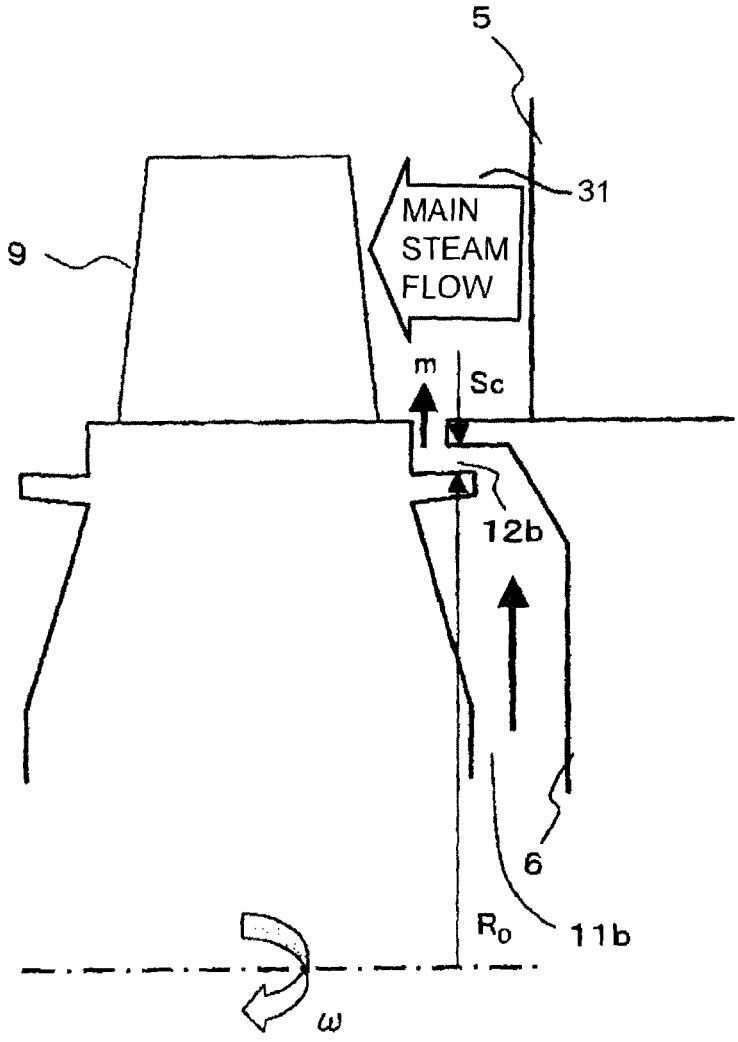
FIG. 2 is a view for explaining a cooling steam flow rate for preventing main steam from flowing into a rotor cooling part.

FIG. 2 is a view for explaining the cooling steam flow rate for preventing the main steam from flowing in the rotor cooling part.

The minimum flow rate (m) of cooling steam for preventing inflow of main steam is represented by the following expression:

$$m = C1(Sc/Ro)^{C2} Rer\, Ro\, \mu$$

where rotating Reynolds number: $Rer = \rho\omega Ro^2/\mu$
gap of seal portion: Sc
radius of seal portion: Ro
rotation speed: $\omega$
density: $\rho$
viscosity coefficient: $\mu$
constants: C1, C2

In the case where the main steam flows into the wheel spaces 11*a* and 11*b*, the abovementioned cooling effect is eliminated to exert serious adverse effect on reliability. Meanwhile, the inflow of a large amount of the cooling steam in the main steam path 31 causes deterioration in the turbine performance and, thus, it is necessary to supply adequate cooling steam flow rate to each stage.

The cooling operation is performed for each required stage and, accordingly, the cooling steam is supplied for each stage, so that the cooling effect is not influenced by a change in the pressure of the stages on the upstream and downstream sides. Further, the flow rate of the cooling steam supplied to each stage can be easily set to an optimum value adjusted by the flow rate control valve 19 and the flow rate control orifice 30, provided in the cooling steam supply line 13. Although the flow rate control valve 19 and flow rate control orifice 30 are provided as flow rate control devices in the example illustrated in FIG. 2, any one of the flow rate control valve 19 and flow rate control orifice 30 will suffice as long as an optimum flow rate can be obtained. With configuration described above, it is possible to obtain effective rotor cooling effect at an optimum cooling steam flow rate.

In the present embodiment, providing the annularly-formed outer ring cavity 15 and inner ring cavity 17 allows the cooling steam to be supplied to the blowing hole 18 at uniform pressure. Further, formation of the radial direction cooling hole 16 allows each stator blade 5 to be cooled. It is possible to further increase thermal efficiency without reducing the efficiency of the steam turbine driven by high temperature steam.

Second Embodiment

Figure 3:
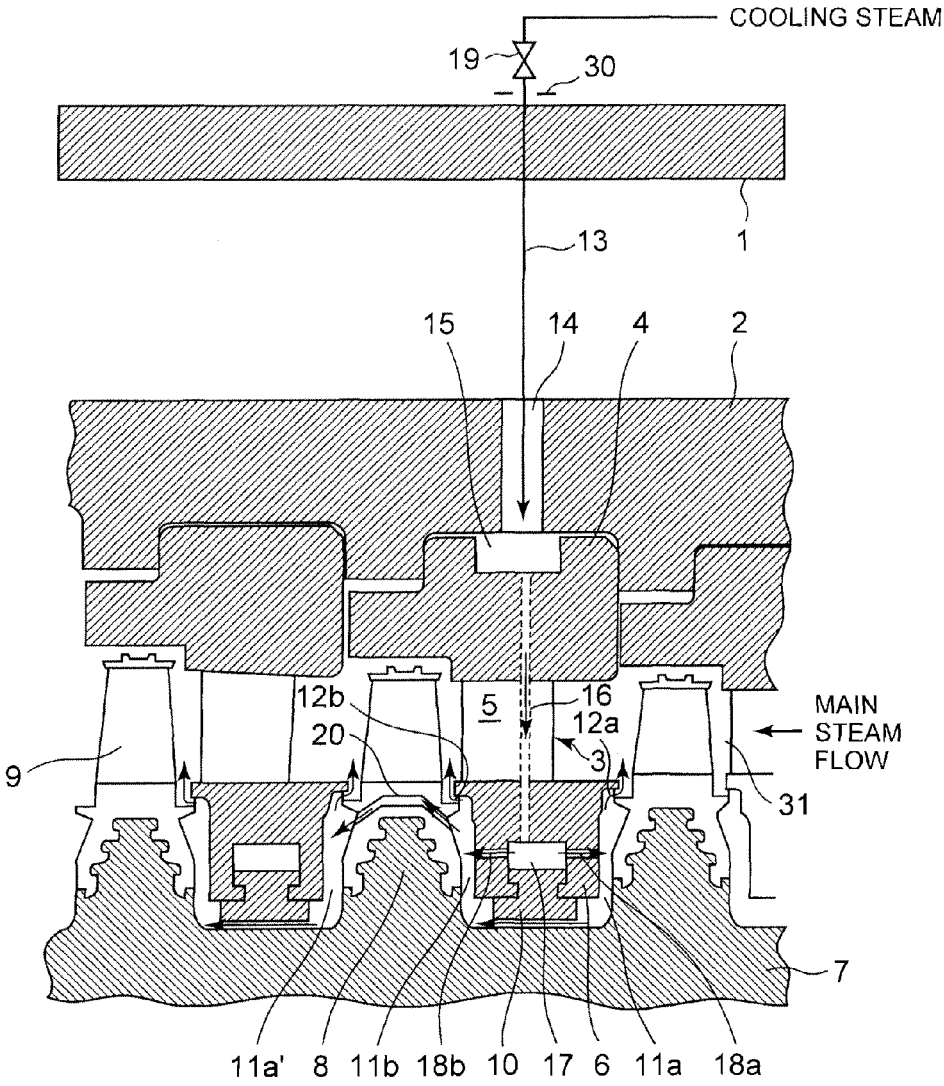
FIG. 3 is an axial direction cross-sectional view illustrating a steam turbine according to a second embodiment of the present invention.

FIG. 3 is an axial direction cross-sectional view illustrating a steam turbine according to a second embodiment of the present invention.

In the first embodiment, the cooling steam is supplied to the outer ring cavity 15 on a per stage basis to cool individual turbine stage; while in the second embodiment, a configuration is adopted in which the cooling steam supplied to one stage is used to cool also an adjacent downstream stage. That is, the second embodiment aims at simplification of the structure.

In the steam turbine according to the second embodiment, a stage receives a supply of the cooling steam from the outer ring side as in the first embodiment. To a stator blade upstream side wheel space 11*a*' in the downstream side stage, the cooling steam is supplied from a balance hole 20 provided in a rotor blade fixing portion. The inner ring 6 has blowing holes 18*a* and 18*b* for blowing the cooling steam in both the directions toward the stator blade upstream side wheel space 11*a* and the stator blade downstream side wheel space 11*b*.

Operation of the present embodiment will next be described.

Cooling steam supplied to the outer ring cavity 15 cools the rotor 7 in the same manner as in the first embodiment. Part of the cooling steam flowing into the stator blade downstream side wheel space 11*b* passes through the balance hole 20 of the rotor blade 9 and flows into the downstream stage to cool the rotor 7. This is made possible by providing the blowing hole 18*b* also on the stator blade downstream side wheel space 11*b* side.

According to the present embodiment, the downstream stage can also obtain the same level of rotor cooling effect as that obtained by the upstream stage, and the need of providing, in the downstream stage itself, a cooling steam inflow structure for allowing the cooling steam to flow from the outer ring side to the wheel space can be eliminated.

Third Embodiment

Figure 4:
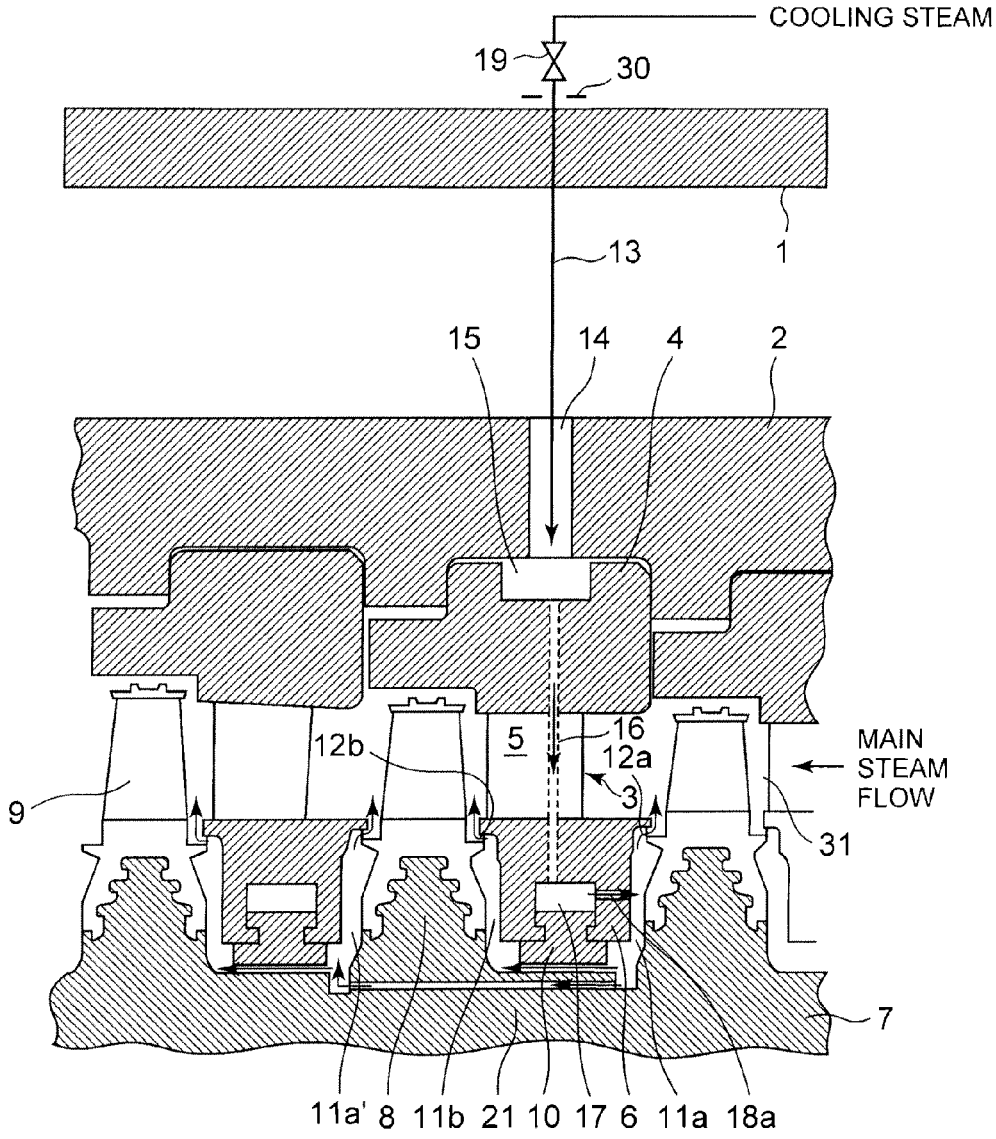
FIG. 4 is an axial direction cross-sectional view illustrating a steam turbine according to a third embodiment of the present invention.

FIG. 4 is an axial direction cross-sectional view illustrating a steam turbine according to a third embodiment of the present invention.

In the present embodiment, in place of the balance hole 20 of the second embodiment, a plurality of intra-rotor connection holes 21 extending from the stator blade upstream side wheel space 11*a* to a stator blade upstream side wheel space 11*a*' of the adjacent downstream stage are formed in the rotor over the entire circumference. The blowing holes 18*b* on the stator downstream side wheel space 11*b* side of the second embodiment can be omitted.

Operation of the present embodiment will next be described.

Part of cooling steam from the stator upstream side wheel space 11*a* directly flows into the stator blade upstream side wheel space 11*a*' of the adjacent downstream stage to cool the rotor 7 of the downstream stage in the same manner as in the second embodiment.

According to the present embodiment, the same effect as in the second embodiment can be obtained.

In the second embodiment, the inner pressure of the stator blade downstream side wheel space 11*b* is tend to be relatively higher than that of the stator blade upstream side wheel space 11*a*' of the adjacent downstream stage because of the configuration in which the cooling steam is supplied from the stator blade downstream side wheel space 11*b* to the stator blade upstream side wheel space 11*a*' via the balance hole 20. Accordingly, the amount of the cooling steam blowing from the wheel space 11*b* to the main steam path 31 is relatively increased, which may cause performance degradation.

On the other hand, in the third embodiment, a sufficient differential pressure can be ensured between the stator blade upstream side wheel space 11*a* and the stator blade upstream side wheel space 11*a*' of the adjacent downstream stage. This eliminates the need to form the blowing hole for blowing the cooling steam to the stator blade downstream side wheel space 11*b* side and reduces the inner pressure of the stator blade downstream side wheel space 11*b*.

Fourth Embodiment

Figure 5:
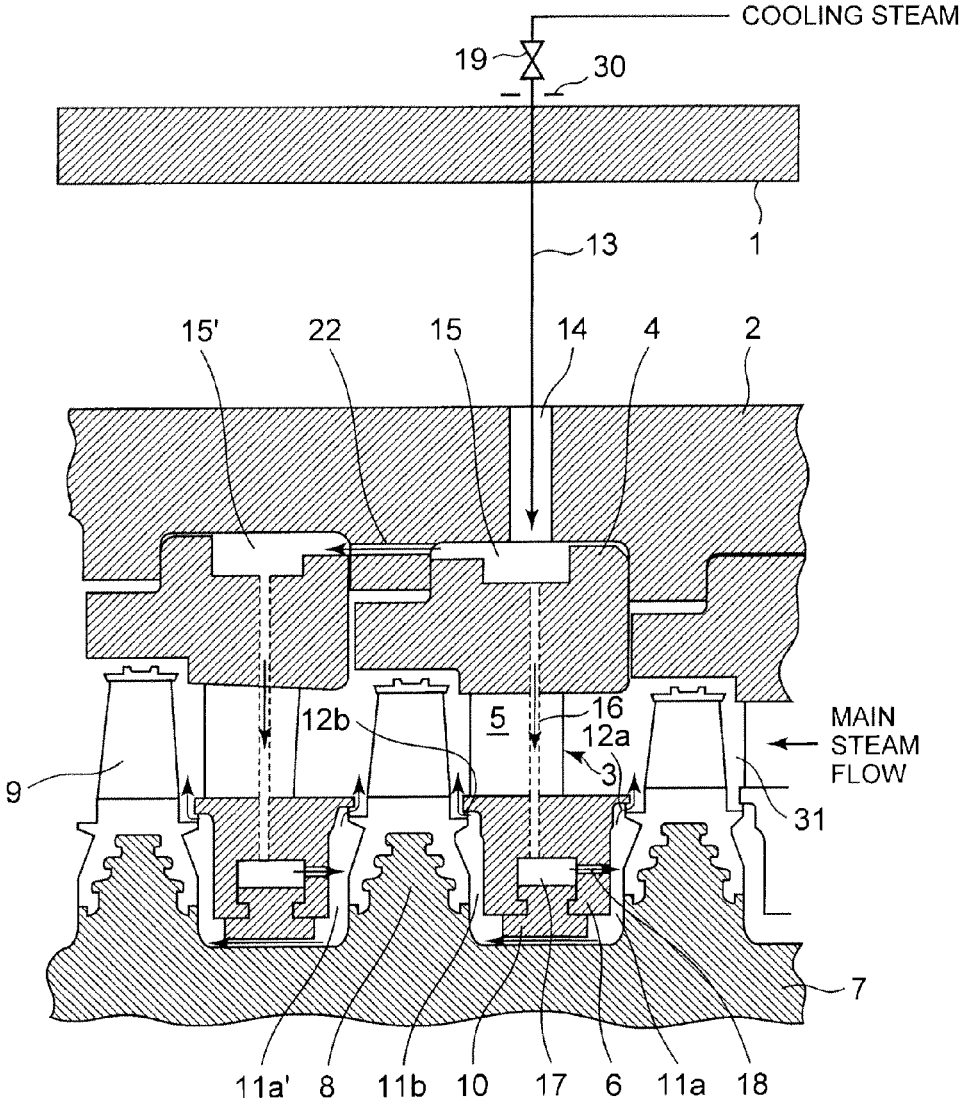
FIG. 5 is an axial direction cross-sectional view illustrating a steam turbine according to a fourth embodiment of the present invention.

FIG. 5 is an axial direction cross-sectional view illustrating a steam turbine according to a fourth embodiment of the present invention.

In the first embodiment, the cooling steam is supplied to the outer ring cavity 15 on a per stage basis to cool individual turbine stage; while in the present embodiment, a configuration is adopted in which the cooling steam supplied to one stage is used to cool also an adjacent downstream side stage as in the second and third embodiments. That is, the fourth embodiment aims at simplification of the structure.

To realize the simplified structure, the second and third embodiments adopt a configuration in which the cooling steam supplied to the upstream stage wheel space is allowed to flow into the downstream stage wheel space via the path formed in the rotor; while the present embodiment adopts a configuration in which a stationary part connection hole 22 connecting the outer ring cavity 15 of the upstream stage and the outer ring cavity 15' of the downstream stage is provided.

Operation of the present embodiment will next be described.

Part of cooling steam supplied to the outer ring cavity 15 passes through the radial direction cooling holes 16 of the stator blades 5 and blows to the stator blade upstream side wheel space 11*a* to cool the rotor 7 as in the first embodiment. The remaining part of the cooling steam flows into the outer ring cavity 15' of the downstream stage via the stationary part connection hole 22, passes through the stator blades 5, blows to the stator blade upstream side wheel space 11*a*' of the downstream stage to cool the rotor 7.

According to the present embodiment, the cooling steam externally supplied to the outer ring cavity 15 flows only in the upstream stage. The downstream stage side receives part of the cooling steam flowing thereto from the upstream stage via the stationary part connection hole 22 and thereby obtains the same level of rotor cooling effect as that obtained by the upstream stage. Further, in the present embodiment, the stator blades 5 of both the upstream and downstream sides can also be cooled as in the first embodiment although the stator blades 5 of the downstream stage is not cooled in the second and third embodiments.

The above configurations of the present invention may be applied not only to the two adjacent stages but adjacent three or more stages.

What is claimed is:

1. A steam turbine comprising:

a plurality of annular diaphragms arranged spaced apart from one another in an axial direction;

a rotor rotatable about its axis, in which a plurality of rotor wheels extending both in a radial direction outward and in a circumferential direction are formed spaced apart from one another in the axial direction at locations sandwiched by the plurality of diaphragms in the axial direction; and a plurality of rotor blades fixed to outsides of the plurality of respective rotor wheels so as to be arranged spaced apart from one another in the circumferential direction, wherein each of the diaphragms includes:

an annular outer ring;

an annular inner ring arranged radially inside of the outer ring; and a plurality of stator blades arranged between the outer ring and inner ring, the stator blades being connected to the outer ring and being spaced apart from one another in the circumferential direction, wherein:

the plurality of outer rings include at least one first outer ring in which an annular outer ring cavity to which external cooling steam is supplied is formed;

a radial direction cooling hole extending in the radial direction while connecting with the outer ring cavity is formed in at least one of the plurality of stator blades connected to the first outer ring;

an annular inner ring cavity connecting with the radial direction cooling hole is formed in a first inner ring constituting one diaphragm together with the first outer ring;

a plurality of cooling steam blowing holes connecting an annular wheel space and the inner ring cavity are formed, the annular wheel space being formed between the first inner ring and one of the rotor wheels that is adjacent to the first inner ring;

a flow rate of steam to be blown from the plurality of cooling steam blowing holes is not less than a minimum flow rate to prevent main steam flowing along outer circumferences of the stator blades and the rotor blades from flowing into the wheel space;

the plurality of outer rings include a second outer ring arranged axially adjacent to the first outer ring and having an annular second outer ring cavity inside thereof;

a second radial direction cooling hole extending in the radial direction while connecting with the second outer ring cavity is formed in at least one of the plurality of stator blades connected to the second outer ring;

a second annular inner ring cavity connecting with the second radial direction cooling hole is formed in a second inner ring constituting one diaphragm together with the second outer ring;

a plurality of second cooling steam blowing holes connecting an annular wheel space and the second inner ring cavity are formed, the annular wheel space being formed between the second inner ring and a rotor wheel adjacent to the second inner ring; and a stationary part connection hole connecting the first outer ring cavity and the second outer ring cavity is formed, wherein cooling steam is fed, in parallel, to the plurality of stator blades that are disposed axially adjacent to each other.

2. The steam turbine according to claim 1, further comprising:

a cooling steam pipe for supplying the external cooling steam to the first outer ring; and a flow rate control device attached to the cooling steam pipe and configured to control a supply flow rate of the external cooling steam.

3. The steam turbine according to claim 2, wherein the flow rate control device includes a flow rate control valve.

4. The steam turbine according to claim 2, wherein the flow rate control device includes a flow rate control orifice.

* * * * *